United States Patent [19]

Sharp et al.

[11] Patent Number: 4,790,410

[45] Date of Patent: Dec. 13, 1988

[54] SAFETY TRACK SUPPORT AND COUPLING

[75] Inventors: George P. Sharp, Clwyd; Thomas W. Brown, Netley Abbey, both of United Kingdom

[73] Assignee: Barrow Hepburn Equipment Ltd., London, England

[21] Appl. No.: 136,348

[22] Filed: Dec. 22, 1987

[30] Foreign Application Priority Data

Dec. 23, 1986 [GB] United Kingdom ..... 8630787

[51] Int. Cl.[4] ..... A62B 37/00

[52] U.S. Cl. ..... 182/36; 182/3; 182/12

[58] Field of Search ..... 182/3, 5–7, 182/12, 36; 188/65.1, 65.2

[56] References Cited

U.S. PATENT DOCUMENTS

| | | | |
|---|---|---|---|
| 3,193,050 | 7/1965 | Galante | 182/3 |
| 4,410,175 | 10/1983 | Shamp | 182/3 |
| 4,674,596 | 6/1987 | Weiner | 182/3 |
| 4,699,245 | 10/1987 | Benedet | 182/3 |
| 4,721,182 | 1/1988 | Brinkmann | 182/3 |

FOREIGN PATENT DOCUMENTS

| | | | |
|---|---|---|---|
| 1178885 | 3/1984 | U.S.S.R. | 182/3 |
| 1178886 | 3/1984 | U.S.S.R. | 182/3 |

*Primary Examiner*—Reinaldo P. Machado

*Attorney, Agent, or Firm*—Dennison, Meserole, Pollack & Scheiner

[57] ABSTRACT

Safety apparatus for used by workers at height comprises a fixed safety cable (1) secured in spaced relation to a fixture (2) by supports such as (3), and a coupling device (8) by which a safety line attached to a worker's safety harness can be coupled to such cable. The coupling device comprises a rotatably mounted tube (9) having a longitudinal slot (16) and profiled ends (9'). The tube (9) is slidable along the cable (1). On abutment of a tube end (9') against an arm (5) of a support (3) the tube becomes rotated to bring the slot (16) into register with the arm (5) so that the coupling device can travel past the support (3).

10 Claims, 5 Drawing Sheets

SAFETY TRACK SUPPORT AND COUPLING

This invention relates to apparatus comprising support means for locally supporting a safety track member in spaced relation to a fixed structure, and coupling means for coupling a load to such track member.

Apparatus of this kind is useful for example in fall-arrest safety installations wherein a safety cable is strung above a work site and workers' individual safety belts or harnesses are coupled to that cable. Another use for apparatus as above referred to is in installations comprising a load-transporting cable which is guided for movement along a predetermined path and which carries coupling means to which a load can be connected.

The design of apparatus of the kind referred to involves the problem that the coupling means coupled to the cable must be able to travel along the path of the cable without being obstructed by cable support means located at intervals along such path.

Certain apparatus embodying a solution to this problem and which is currently in use, is described in GB No. 1 572 201, This apparatus comprises a wheel having means by which it can be connected to the cable while leaving the wheel free to rotate about an axis transverse to the path of the cable, and the wheel has a series of peripheral recesses which serve in conjunction with guide means associated with the wheel to permit a device attached to the cable to travel past the wheel.

The present invention provides an alternative solution to the problem above referred to and affords certain advantages in regard to simplicity of construction.

According to the present invention there is provided apparatus comprising support means for locally supporting a safety track member in spaced relation to a fixed structure, and coupling means for coupling a load to such track member, said support means and said coupling means being constructed and arranged to enable said coupling means to pass said support means during travel of said coupling means along the path of said track member, characterised in that either said support means or said coupling means comprises an arm for attachment to a said fixed structure or to a load as the case may be, whereas the other of said support and coupling means comprises (i) a tube which defines a passageway for said track member, such tube being peripherally interrupted along its length by a slot which is wide enough to allow said arm to pass therealong, and (ii) a bearing part which rotatably supports said tube but so as to allow said arm to pass by such bearing part; at least one end of said tube being shaped so that axial abutment pressure of said arm against said end causes rotation of the tube to bring the adjacent end of said slot into line with such arm.

Apparatus according to the invention can be of relatively simple construction, while being very reliable in use.

The invention includes an installation comprising apparatus as above defined in combination with a safety track member, which member can for example be in the form of a flexible cable or a rail. In such an installation there will usually be a plurality of said safety track support means for locally supporting the track at a plurality of positions along its course. The installation may include a plurality of said coupling means In installations as just referred to the safety track can be fixed. A fixed safety track is normally employed in fall-arrest safety installations, which is the most important field for use for the invention. In the case that the safety track is fixed, the coupling means must be freely movable along such track.

The slot of the rotatable tube preferably follows along the tube a path which over at least part of its length is inclined to planes containing the axis of the tube. The reason for this preference is that it avoids or reduces any tendency for the track member to become wedged in or to be forced out of the slot under loading forces on the track member. The strength requirements for the tube material are therefore less.

According to another preferred feature, the path of the slot follows a curve from one end of the tube to the other. That path, considered from either end of the tube, may wind unidirectionally around the tube axis, i.e. it may follow a generally helical path. Alternatively the path may wind first in one direction around part of the tube periphery and then in the reverse direction. This latter configuration enables the tube to be shorter for a given slot inclination.

In certain embodiments of the invention, the angular extent of the bearing part which rotatably supports the slotted tube is such that said bearing part leaves an unobstructed by-pass gap which is substantially wider than the arm (belonging to the track support means or the coupling means) which extends into that gap during traverse of the coupling means past the track support means. The importance of this feature lies in the fact that the coupling means does not have to be in one particular angular relationship to the support means in order for such traverse to be possible. On the contrary such traverse can occur whatever be the relative angular orientation of the different means within a certain range which is determined by the width of the said by-pass gap. This is an important consideration in many safety installations. Preferably the bearing part supporting the rotatable tube leaves a said by-pass gap which subtends an angle of at least 80° about the tube axis.

The safety track support means may comprise a track-supporting arm which is hinged to a base plate or other fixing portion of such support means so that any loading force exerted on the track member out of line with the hinge axis causes the track member to rock about such axis. In these circumstances the support means tends naturally to assume an orientation which will allow passage of the coupling means past the track support means even if the aforesaid by-pass gap is not much wider than the arm which has to pass along it.

For most envisaged uses of apparatus according to the invention, it is necessary for each end of the rotatable tube to be shaped to convert local axial pressure against that end into a turning moment causing rotation of the tube. Automatic rotation of the tube into by-pass position will then take place regardless of which end of the tube is subjected to axial abutment pressure by the arm of the support means or the coupling means as the case may be. This will normally be necessary when a load, e.g. a safety line attached to a worker's safety harness, has to be free to move to and fro along the safety track. However, circumstances may occur in which a load has only to be moved in one direction parallel with the safety track and in those circumstances the special shaping is required at one end only of the tube. As an example of such circumstances, the coupling means of apparatus according to the invention can be coupled to a safety track in the form of an endless driven cable which passes around drums or sheaves at feed and delivery ends of a transportation path and which is supported by track support means as hereinbefore referred to at least one position along its course. A load to be transported can be connected to said coupling means when it is at the beginning of one reach of the cable and detached from such coupling means on reaching the delivery end of that reach. In such an installation the coupling means attached to the cable always travels past the cable supporting means in one direction.

Certain embodiments of apparatus according to the present invention, selected by way of example, will now be described with reference to the accompanying drawings, in which.

Figure 1:
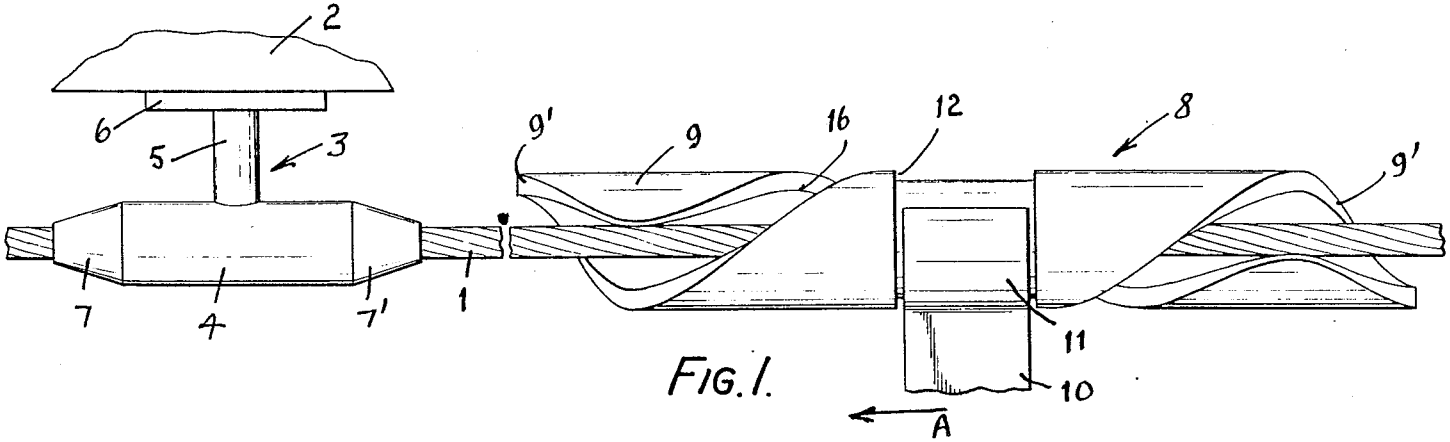
FIG. 1 is an elevation of part of an installation incorporating an apparatus according to the invention.

Referring firstly to FIGS. 1 to 4: the installation comprises a strung cable 1 which is secured to a fixture 2. At intervals along its length the cable is locally supported by cable-supporting members 3. Each of such members comprises a tubular head portion 4 having tapered end portions 7,7'. The head portion 4 is integral with or connected to one end of an arm 5 the other end of which is connected to a fixing plate 6 which is secured to a fixed structure 2. The cable 1 has been threaded through the head portion 4.

A component 8 from which a safety line can be suspended is coupled to the cable 1. This component constitutes the second component of the apparatus according to the invention. This component comprises a tube 9 through which the cable 1 has been threaded. The internal diameter of this tube is in excess of the external diameter of the head portion 4 of the cable-supporting component 3. The component 8 further comprises an arm 10 having an arcuate bearing part 11 which embraces but does not grip the tube 9 at a central zone thereof which is of reduced external diameter and forms a peripheral groove 12 in which the bearing part is accommodated. The tube 9 is thus rotatably supported by the bearing part 11 while being held against axial displacement relative thereto. The bearing part 11 subtends an angle which is greater than 180° but significantly less than 360° so that between its edges 13,14 there is an unobstructed gap for the passage of the arm 5 of the component 3 as hereinafter described. In the arm 10 there is an aperture 15 (FIG. 4) through which a hook on a safety line attached to a safety harness can be engaged.

The wall of tube 9 is peripherally interrupted by a slot 16 which follows a helical course from one end of the tube to the other. This slot has a width in excess of the diameter of the arm 5 of the cable-supporting component 3. Each end 9' of tube 12 is profiled so as to provide guide edges which are inclined towards the slot.

The traverse of component 8 past component 3 will now be described, assuming that the component 8 is drawn along the cable 1 by the attached safety line (not shown) in the direction of the arrow A in FIG. 1.

Figure 2:
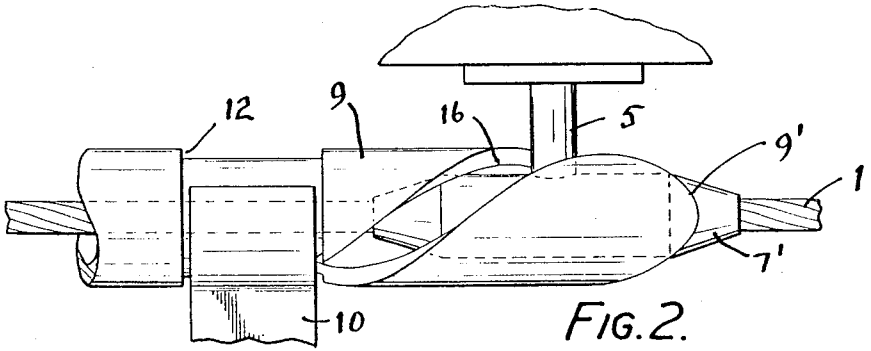
FIG. 2 shows the same part of the installation with the components of said apparatus in different relative positions.
Figure 3:
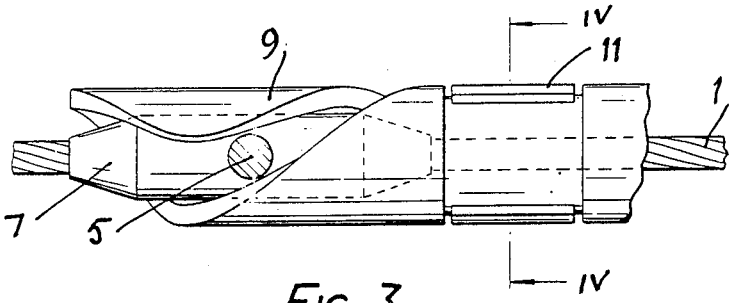
FIG. 3 shows those components in other relative positions.
Figure 4:
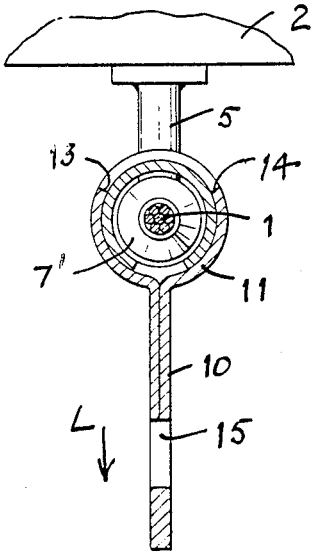
FIG. 4 is a cross-section on line IV—IV in FIG. 3.

In FIG. 1 the component 8 is shown with the tube 9 co-axial with the cable 1. In fact, until it reaches the head portion 4 of component 3, the inside of the tube bears on the cable 1. When the leading end of tube 9 reaches component 3, the leading end of the tube is caused to ride up over the head portion 4 by its tapering end portion 7'. If the leading end of the slot 16 in the tube 9 happens to be in line with the arm 5 of the cable-supporting component 3 when the tube reaches that arm, the arm will directly enter that slot. If the leading end of the slot happens to be out of line with the arm 5, the end of the tube 9 will abut against the arm but because of the inclination of the end edge of the tube, the abutment pressure will cause rotation of the tube into a position in which the arm 5 can enter the slot and the axial movement of the tube can continue. As the axial movement of component 8 continues, the bearing pressure of the arm 5 against an edge of the helical slot causes rotation of the tube to allow passage of the arm along the entire length of the slot. FIG. 2 shows the tube 12 at a stage towards the end of its traverse over the head portion 4 of the component 3. FIG. 3 is a view from below, showing an earlier stage, when the arm 5 is at the entrance to the slot 16.

The arm 5 offers no obstruction to the passage of the arcuate bearing part 11 of the component 8 provided that this component 8 is oriented so that the lines of motion of the boundary edges 13,14 of the mouth of that bearing part are to opposite sides of the arm 5. As can be seen from the drawings (FIGS. 3 and 4), the width of that mouth is substantially greater than the parallel cross-sectional dimension (diameter) of the arm 5 and in the specific illustrated embodiment the arm 5 will in fact offer no obstruction to the passage of the bearing part 11 provided that the component 8 is oriented so that its arm 10 is within about 50° from the vertical. The component will always have an orientation within this range during the normal intended use of the apparatus.

Because the two halves of the length of tube 9 are similarly shaped, the manner in which it co-operate with the head portion 4 of the cable-supporting component 3 to allow passage of component 8 past component 3 during travel or component 8 in the opposite direction along cable 1 is essentially the same.

Figure 5:
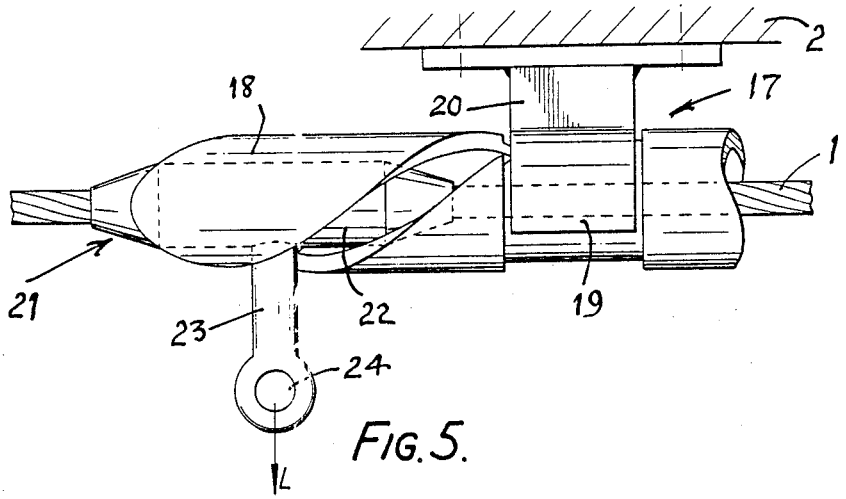
FIG. 5 is a view, similar to FIG. 1, of another apparatus according to the invention.

With small design modifications, component 8 could be secured to a fixture and serve as a local cable support, and component 3 could be used as the travelling coupling component to which the load is attached. FIG. 5 shows such an embodiment of the invention. Referring to this figure: the cable-supporting component 17 comprises a longitudinally slotted tube 18 which is rotatably supported in a bearing part 19 on an arm 20. The tube and bearing part are identical with the tube 9 and bearing part 11 of the apparatus shown in FIGS. 1 to 4. However the bearing part 19 and its arm 20 form part of a bracket by which the component 17 is secured to a fixture 2. The coupling component 21 in FIG. 5 comprises a tubular head portion 22 through which the cable 1 extends and an arm 23 having an eye 24 for connection to a safety line. If the cable 1 is fixed, the coupling component must be freely slidable along the cable. In the case that the cable is part of a load-transporting installation and is driven, the head portion 22 of the coupling component 21 is secured to the cable, e.g. by swaging or by clamping screws.

Figure 6:
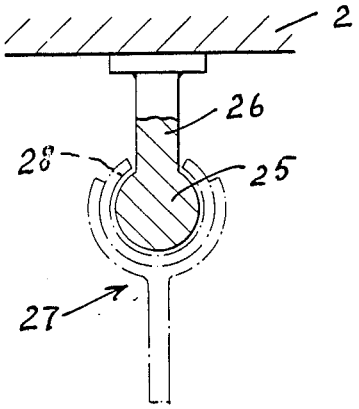
FIG. 6 is an end section of a safety track member.

Apparatus according to the invention can be of such form that it can be used in conjunction with a safety cable or with a safety track in the form of a rail. For example the apparatus described with reference to FIGS. 1 to 5 would function in the same way if the cable 1 were replaced by a substantially rigid metal bar or tube. FIG. 6 shows apparatus according to the invention specifically designed for use with a rail. In this figure, a rail member 25 is locally supported by an arm 26 which forms part of a bracket for securing to a fixture 2. The arm 26 can be integral with the rail member or it can be separately fabricated and secured to the rail member by welding or in any other suitable manner. The coupling component 27 is similar to the coupling component 8 shown in FIGS. 1 to 4. The longitudinally slotted tube 28 of component 27 slides along the rail member 25.

Reference is now made to the apparatus represented in FIGS. 7–10. In this apparatus the cable 1 is supported at intervals along its length by supporting members 30 comprising an arm 31 which is pivotally connected to a bracket 32 by a rivet 32'. The bracket 32 is secured to a fixture 2. The cable 1 passes through a tubular head portion 33 of the arm 31. The head portion 33 is connected to the inner part of the arm by thin connecting webs 34. The tubular head portion 33 has tapered end extension pieces 35,36 of plastics material. Each of these pieces comprises a longitudinally slotted tube having at its wider end an internal annular rib which is snap-fitted into an external peripheral groove 37 on the tubular portion 33.

An end link or hook H of a safety line is connected to a component 38 which is freely slidable along the cable 1. Component 38 comprises a body 39 in which a tube 40 is rotatably mounted. The tube 40 has end portions of reduced diameter on which nylon bearing rings 41,42 are fitted. The tube and bearing rings are inserted, as an assembly, endwise into a passageway in the body 39, to bring bearing ring 42 into abutment with a shoulder near one end of such body. The assembly is retained in that passageway by a retaining plate 43 which is fitted over the opposite end of the tube and secured to the body 39. The wall of the said passageway in the body 39 does not completely surround the periphery of the tube 40. A gap 44 is left between opposed parts of such wall.

The link or hook H is engaged with an arcuate slot 45 provided in body 39 at a region opposite the gap 44. The link or hook is freely movable along slot 45. During use of the apparatus, the link or hook assumes a position against one or the other end of the slot 45, depending on the direction in which the safety line tends to be pulled by movement of the person to whom the safety line is attached.

The tube 40 has an internal diameter in excess of the external diameter of the tubular head portion 33 of the cable supporting member 30. Like the tube 9 of the component 8 in FIGS. 1–4, the tube 40 is peripherally interrupted by a slot. However, the slot 46 in tube 40 winds first in one direction and then in the reverse direction around part of the periphery of the tube, as appears in FIG. 9. Each end of the tube is profiled so as to provide inclined guide edges 47 which are inclined towards the end of the slot.

Whenever the component 38, during its entrainment in either direction along the safety line 1 by the safety line, reaches a cable-supporting member 30. the leading end of the tube 40 rides over the adjacent tapered end extension piece 35 or 36 of the head portion 33 of such member so that the said leading end of the tube 40 reaches one of the two webs 34. As appears in FIG. 10, each of these webs has tapered edges 48. If the tube 40 reaches the web with the slot 46 and the web in register, the web enters the slot as the movement of the component along the cable 1 continues, and the tube 40 becomes rotated first in one direction and then in the opposite direction by the pressure of the two webs against the sides of the slot. If the slot 46 arrives at a web 34 out of register therewith, the web is struck by the inclined end edge 47 of the tube and this edge acts as a cam to cause the tube to rotate into a position in which the web enters the slot.

The webs 34 can only pass along the slot 46 if they are also in register with the gap 44 in the body 39 of component 38. Because the arm 31 of the cable-supporting member 30 is freely pivotable relative to the fixed bracket 32, if a pull is exerted on the cable 1, in the vicinity of the arm 31 and in a direction such as to impose a turning moment on that arm, the arm tends to swing about its pivotal axis so that it becomes approximately aligned with the direction of the pull. Consequently the arm 31 tends naturally to assume a position such that the webs 34 are in the path of the said gap 44 in the body 39 of component 38. The width of the gap 44 is however preferably significantly greater than the thickness of the webs 34 so as to provide ample alignment tolerance.

Figure 11:
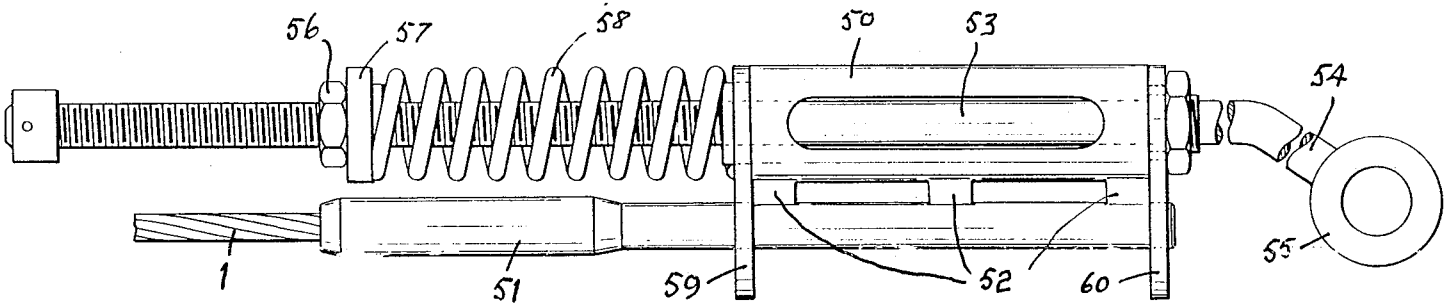
FIG. 11 is an elevation of a cable anchoring and tensioning device.
Figure 12:
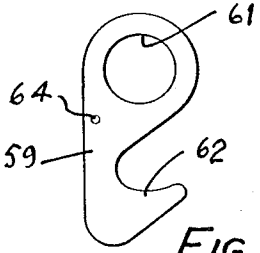
FIG. 12 shows a detail of the device shown in FIG. 11.

FIGS. 11 and 12 show a cable tensioning and anchoring device for connecting an end of cable 1 to a fixture.

The device comprises a tubular casing 50 to which a cable end fitting 41 is connected by connecting pieces 52. An end portion of cable 1 is secured in this end fitting, e.g. by swaging or by clamping screws. A bar 53 extends axially through the casing 50 and the end of this bar which projects from the rear end of casing 50 is connected to or integral with an arm 54 having a terminal eye 55 for the passage of a bolt (not shown) by means of which the device can be anchored to a fixture.

Another section of the length of bar 53 projects from the front end of casing 50 and is externally threaded. A tension adjustment nut 56 is screwed onto this part of the bar. Behind nut 56 is a ring 57 and between this ring and the front end of the casing 50 there is a shock-absorbing compression spring 58.

The cable 1 is tensioned to a required extent by rotating the nut 56. Advance of the nut towards the right in the aspect of FIG. 11 causes axial displacement of casing 50 and cable end fitting 51 in the same direction, thereby increasing the cable tension. Reverse movement of the nut has the opposite effect.

If a worker whose safety line is attached to cable 1 should fall, the shock load transmitted to the cable via the safety line will be absorbed by the spring 58 which will accordingly serve to protect the worker from serious injury due to very abrupt arrest of the fall. Usually, the worker's safety line will itself have shock-absorbing properties.

The cable tensioning and anchoring device allows a coupling component such as 38 (FIG. 7) to be threaded onto the cable 1 at one end while the cable remains anchored. For this purpose the connecting pieces 52 which connect the cable end fitting 51 to the casing 50 are thin enough to pass along the gap 44 and slot 46 in component 38. In order to prevent component 38 from unintentional displacement off the cable and its end fitting, the cable tensioning and anchoring device incorporates two safety catches 59, 60, one of which is shown in elevation in FIG. 12. Each catch has an aperture 61 through which the bar 53 passes, and a hook portion 62 which engages around the cable end fitting 51.

In order to thread a coupling component such as 38 onto the cable, first catch 60 and then latch 59 is temporarily swung, against the biasing action of a torsion spring (not shown), into a position in which the hook portion 62 is disengaged from the end fitting 51 and the component 38 is passed along the end fitting past that catch, which is then released to return to its operative position. The torsion spring associated with each catch extends from a point 64 on the catch to a point on the casing 50.

Figure 7:
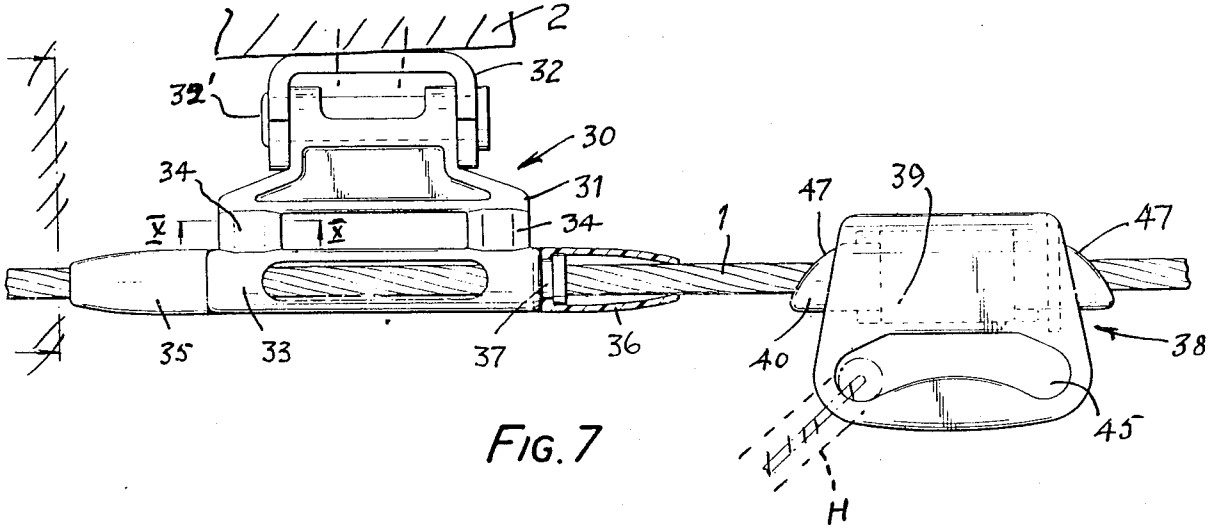
FIG. 7 is an elevation of another apparatus according to the invention.
Figure 10:
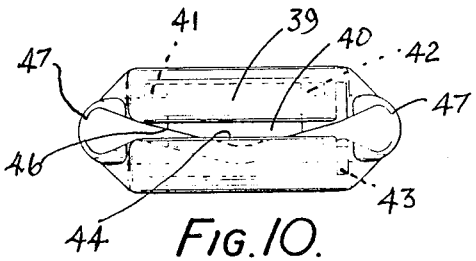
FIG. 10 is a detail in section on line X—X in FIG. 7.
Figure 9:
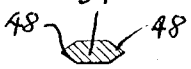
FIG. 9 is a plan view of the coupling component shown in FIG. 7.
Figure 8:
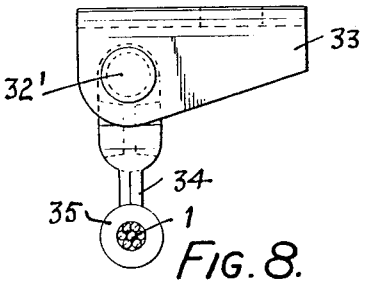
FIG. 8 is an end view of the cable-supporting member shown in FIG. 7.

For additional safety, shock-absorbing means can be incorporated in the cable-supporting members, e.g. between the arm 31 and bracket 32 in FIG. 7, for absorbing load in the event that the coupling member is in engagement with such a supporting member at the time of a fall.

What is claimed is:

1. Apparatus comprising support means (7,17,30) for locally supporting a safety track member (1) in spaced relation to a fixed structure (2), and coupling means (8,21,38) for coupling a load to such track member (1), said support means and said coupling means being constructed and arranged to enable said coupling means to pass said support means during travel of said coupling means along the path of said track member (1), characterised in that either said support means (7,17,30) or said coupling means (8,21,38) comprises an arm (5,23,26,31) for attachment to a said fixed structure (2) or to a load as the case may be, whereas the other of said support and coupling means comprises (i) a tube (9,18,28,40) which defines a passageway for said track member (1), such tube being peripherally interrupted along its length by a slot (16,46) which is wide enough to allow said arm (5,23,26,31) to pass therealong, and (ii) a bearing part (11,19,39) which rotatably supports said tube (9,18,28,40) but so as to allow said arm (5,23,26,31) to pass by such bearing part; at least one end (9',47) of said tube (9,18,28,40) being shaped so that axial abutment pressure of said arm (5,23,26,31) against said end causes rotation of the tube to bring the adjacent end of said slot (16,46) into line with such arm.

2. Apparatus according to claim 1, wherein said arm (5,23,31) projects from a head portion (4,22,33) defining a passageway through which a track member in the form of a strong cable can extend.

3. Apparatus according to claim 1 or 2, wherein the slot (16,46) of the rotatable tube (19,18,28,40) follows along the tube a path which over at least part of its length is inclined to planes containing the axis of the tube.

4. Apparatus according to claim 3, wherein said slot (16,46) follows a smoothly curved path from one end of the tube (9,18,28,40) to the other.

5. Apparatus according to claim 3, wherein the angular extent of the bearing part (11,19,39) around the rotatable tube (9,18,28,40), is such that said bearing part leaves an unobstructed by-pass gap which is substantially wider than the arm (5,23,26,31) which extends into that gap during traverse of the coupling means past the track support means or vice versa.

6. Apparatus according to claim 3, wherein the track support means (30) comprises a track supporting arm (31) which is hinged to a base plate or other fixing portion (32) of such support means.

7. A fall-arrest safety installation comprising apparatus according to claim 3 and an anchored safety track member (1), said track member being locally supported at at least one position along its length by track support means (7,17,30) of said apparatus and the coupling means (8,21,38) of such apparatus being slidable along said track member.

8. A fall-arrest safety installation according to claim 7, wherein said track member (1) is a cable.

9. Apparatus according to claim 1, wherein the angular extent of the bearing part (11,19,39) around the rotatable tube (9, 18, 28, 40), is such that said bearing part leaves an unobstructed by-pass gap which is substantially wider than the arm (5,23,26,31) which extends into that gap during traverse of the coupling means past the track support means or vice versa.

10. A fall-arrest safety installation comprising apparatus according to claim 1 and an anchored safety track member (1), said track member being locally supported at at least one position along its length by track support means (7, 17, 30) of said apparatus and the coupling means (8, 21, 38) of such apparatus being slidable along said track member.

* * * * *